US005853287A

United States Patent [19]

Iida et al.

[11] Patent Number: 5,853,287

[45] Date of Patent: Dec. 29, 1998

[54] SCROLL COMPRESSOR HAVING A THRUST PLATE

[75] Inventors: Noboru Iida, Kusatsushi; Hiroyuki Fukuhara, Otsushi; Shigeru Muramatsu, Kusatsushi, all of Japan

[73] Assignee: Matsushita Electric Industrial Co., Ltd., Osaka, Japan

[21] Appl. No.: 803,270

[22] Filed: Feb. 20, 1997

[30] Foreign Application Priority Data

Feb. 20, 1996 [JP] Japan ..... 8-031804

[51] Int. Cl.[6] ..... F04C 18/04

[52] U.S. Cl. ..... 418/55.1

[58] Field of Search ..... 418/55.1

[56] References Cited

U.S. PATENT DOCUMENTS 4,795,324 1/1989 Matsugi et al. ..... 418/55.1

5,382,143 1/1995 Nakamura et al. ..... 418/55.1

FOREIGN PATENT DOCUMENTS 4-262083 9/1992 Japan ..... 418/55.1

4-284193 10/1992 Japan ..... 418/55.1

*Primary Examiner*—John J. Vrablik

*Attorney, Agent, or Firm*—Price Gess & Ubell

[57] ABSTRACT

A thrust plate disposed between an orbiting scroll member and a bearing for receiving a force axially exerted thereon is provided with a protrusion formed on the same plane as the thrust plate and projected radially inward. The bearing has a thrust plate holder comprising a recess to which the protrusion of the thrust plate fits in, by which the thrust plate is prevented from rotating while being able to move smoothly in an axial direction. Abrasion caused by rotation of the thrust plate is thus prevented, as well as abrasion on outer circumferential parts of the thrust plate can be prevented as a result of the thrust plate is capable of slightly shifting for adjustment to follow up any precessional movement of a thrust load.

6 Claims, 4 Drawing Sheets

SCROLL COMPRESSOR HAVING A THRUST PLATE

BACKGROUND OF THE INVENTION

1. Technical Field of the Invention

The present invention relates to a scroll compressor employed in an air conditioner or the like for business or domestic use.

2. Description of Related Art

The entire construction of a conventional scroll compressor will be hereinafter described referring to FIG. 2. In a scroll compressor housing 1, a fixed scroll member 2 and an orbiting scroll member 3 are disposed in such a manner to provide a compressing element. A stator 4 and a rotor 5 constitute an electric motor element, and a crankshaft 6 functions as a transmitting element for conveying rotation of the electric motor element to the compressing element. Also disposed is a rotation restricting member 7 for preventing rotation of the orbiting scroll member 3. A suction duct 8 for drawing in a low pressure refrigerant and a discharge duct 9 for discharging a pressurized refrigerant are disposed on a side face of the scroll compressor housing 1.

The fixed scroll member 2 has an involutely projecting fixed scroll vane 2*a* on its bottom surface and a discharge port 2*b* positioned in its center. The orbiting scroll member 3 has an orbiting scroll vane 3*a* projected from the top surface, having similar but reversely involuting protrusions for meshing with the fixed scroll vane 2*a*.

An upper portion of a crankshaft 6 is freely received in and rotatably supported by a bearing 10 which is fixedly set in the scroll compressor housing 1. An orbiting scroll vane shaft 3*b* disposed to project from a base of the orbiting scroll member 3 eccentrically mounted on the crankshaft 6 is nested in the upper portion of the crankshaft 6. The annular rotation restricting member 7 has diagonal protrusions on each of its top and bottom surfaces and is disposed between the orbiting scroll member 3 and the bearing 10 in such a way that it can rotate along the inner circumferential wall of the housing 1 so as to cause the orbiting scroll member 3 to orbit around the axis of the crankshaft 6 by rotation thereof. Between the orbiting scroll member 3 and the bearing 10 is also provided a thrust plate 11 for catching a downward force generated by compressing the refrigerant.

When the crankshaft 6 is driven to rotate by the rotor 5 constituting the electric motor element, the orbiting scroll member 3 orbits around the axis of the crankshaft 6 by the function of the rotation restricting member 7. The compression pockets formed between the scroll vanes 2*a*, 3*a* of the fixed scroll member 2 and the orbiting scroll member 3 intermeshing with each other decrease in volumetric capacity while moving from the outer side toward the central part. In other words, a low pressure refrigerant drawn in from the side of the housing 1 is first sealed in the compression pockets formed between the outer circumferential walls of the fixed scroll member 2 and the orbiting scroll member 3, compressed while the compression pockets move toward the center, and discharged from the discharge port 2*b* disposed in the center of the fixed scroll member 2.

When the refrigerant is being compressed between the interlocking scroll members 2 and 3, a downward force is generated by rotation of the scroll members and exerted on the orbiting scroll member 3, as the fixed scroll member 2 is firmly mounted within the housing 1. The thrust plate 11 disposed between the orbiting scroll member 3 and the bearing 10 to catch this downward force usually tends to rotate itself, as the thrust plate 11 receives not only a thrust force from the pressured refrigerant but also a force generated by orbiting movement of the orbiting scroll member 3. Therefore, there has been a problem that the thrust plate 11 and the bearing 10 are soon worn out especially in their contacting parts.

Even if the thrust plate 11 is fixed to the bearing 10 by a screw or the like to prevent its rotation, or the thrust plate 11 is not provided between the orbiting scroll member 3 and the bearing 10, the outer circumferential surface of the thrust plate 11 or the corresponding parts of the orbiting scroll member 3 contacting with the thrust plate 11 will still be abraded because of a precessional thrust load exerted from the orbiting scroll member 3 on the thrust plate 11, as a result of which the thrust plate 11 receives the thrust load on its outer circumferential edge.

It is also possible to fasten the thrust plate 11 by a pin 21 as shown in FIG. 3. In that case, however, a securing means for preventing the pin 21 from slipping will be further required, as well as the portion where the pin 21 is thrusted in will need to be made precisely, in addition to the above described problem of abrasion.

The thrust plate 11 can also be so constructed as to have a folded portion 22 which is to be fitted in a coupling member formed in the bearing 10 as shown in FIG. 4. However, such folded portion 22 would obstruct smooth shifting of the thrust plate 11 such as slightly tilting or rising for adjustment to follow up the precessional movement of the thrust load exerted thereon. It is also difficult to precisely produce a thrust plate 11 with such a folded portion 22. The above described problem of abrasion is thus not solved by this means either.

BRIEF SUMMARY OF THE INVENTION

In view of the foregoing, it is a primary object of the present invention to provide a scroll compressor being capable of preventing abrasion of a thrust plate by stopping rotation of the thrust plate as well as preventing abrasion of an outer circumferential surface of the thrust plate by following up a precessional movement of thrust loads exerted thereon.

In order to accomplish the above said object, the scroll compressor of the present invention comprises a fixed scroll member having a fixed scroll vane; an orbiting scroll member having an orbiting scroll vane interlocked with the fixed scroll vane for forming a plurality of compression spaces; a crankshaft for driving to orbit the orbiting scroll member: a bearing for supporting a main axis of the crankshaft; a circular thrust plate disposed between the orbiting scroll member and the bearing for creating a receiving a force axially exerted thereon from the orbiting scroll member; and a mating means for preventing rotation of the circular thrust plate while permitting the thrust plate to shift in an axial direction.

The mating means holds the thrust plate so as not to rotate and thereby prevents abrasion caused by rotation of the thrust plate. Also, abrasion in the outer circumferential parts of the thrust plate is prevented by its capability of slightly shifting in an axial direction to follow up a precessional movement of a thrust load exerted thereon.

The mating means can be constructed with a protrusion formed on the same plane as the thrust plate and projected inwardly in a radial direction, and a thrust plate holder formed in the bearing for coupling with the protrusion. By forming the protrusion on the thrust plate on one plane, it can be precisely produced.

Further, by forming the thrust plate to have a circular outer periphery and by projecting the protrusion from an inner periphery thereof, deflected abrasion on the outer circumference of the thrust plate caused by a precessional movement of a thrust load can be prevented.

Moreover, since the thrust plate holder comprises a circular boss provided on the bearing to which the inner periphery of the thrust plate fits in, and a recess formed in the circular boss having a greater depth than the height of the circular boss, deflected abrasion can also thereby be prevented because the thrust plate is stably held in position as well as the recess provides a space for the protrusion to escape therein on receiving a thrust load.

DETAILED DESCRIPTION OF THE INVENTION

Figure 1:
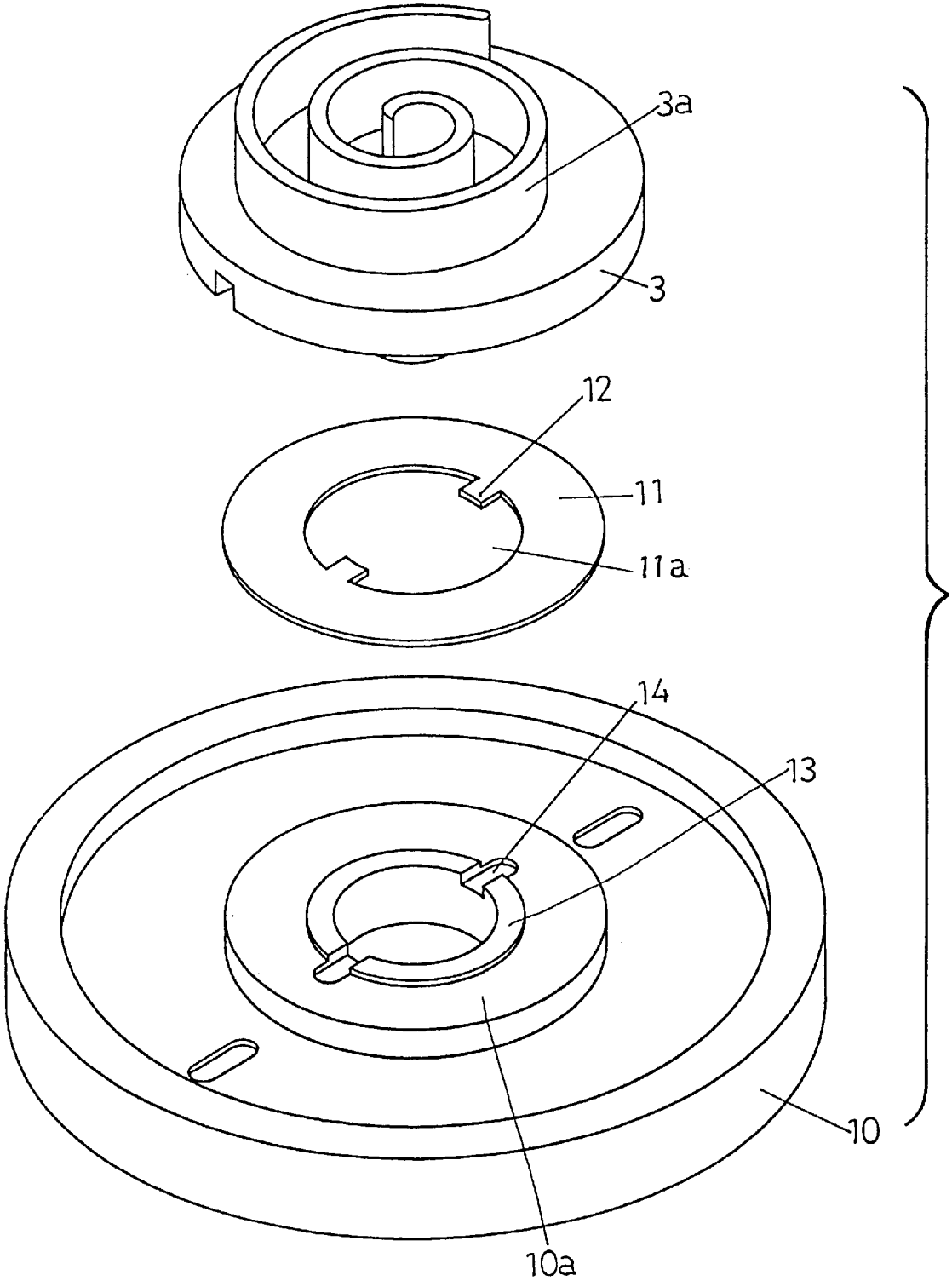
FIG. 1 is an exploded perspective view showing a configuration where a thrust plate is disposed in an embodiment of the scroll compressor according to the present invention.
Figure 2:
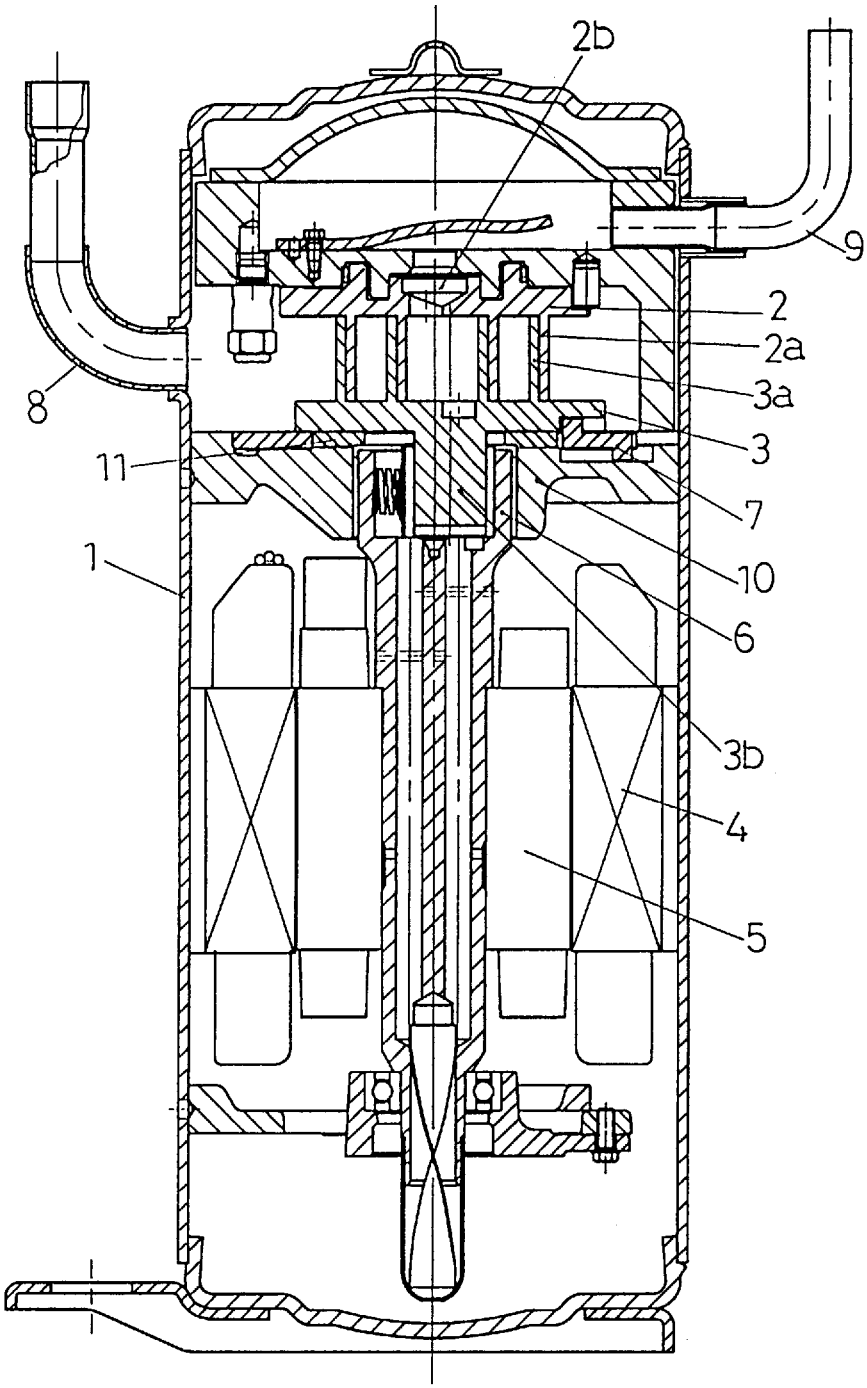
Fig. 2 PRIOR ART
FIG. 2 is a longitudinal sectional front view of a conventional scroll compressor.
Figure 3:
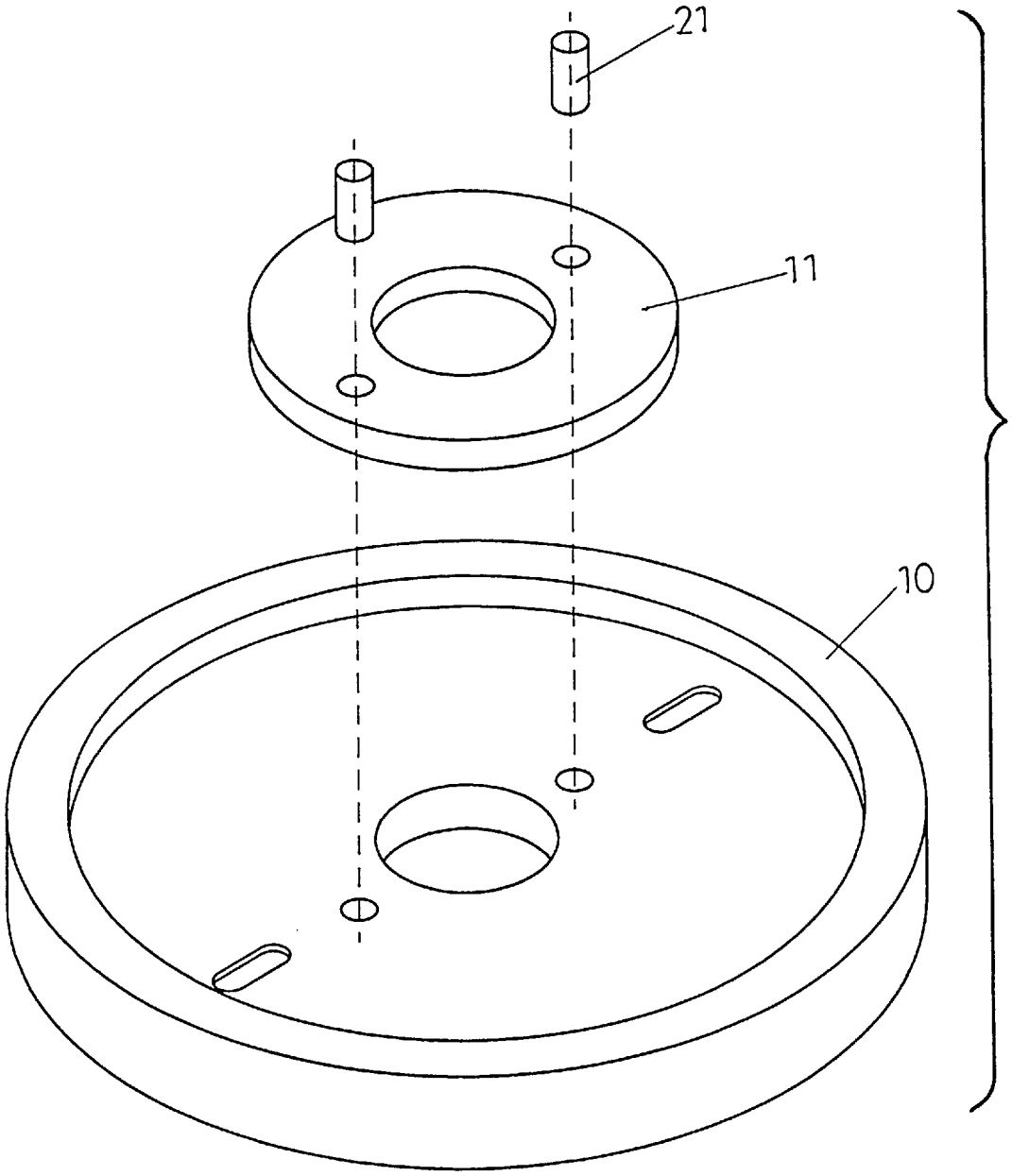
Fig. 3 PRIOR ART
FIG. 3 is an exploded perspective view showing one example of method of fixing a thrust plate.
Figure 4:
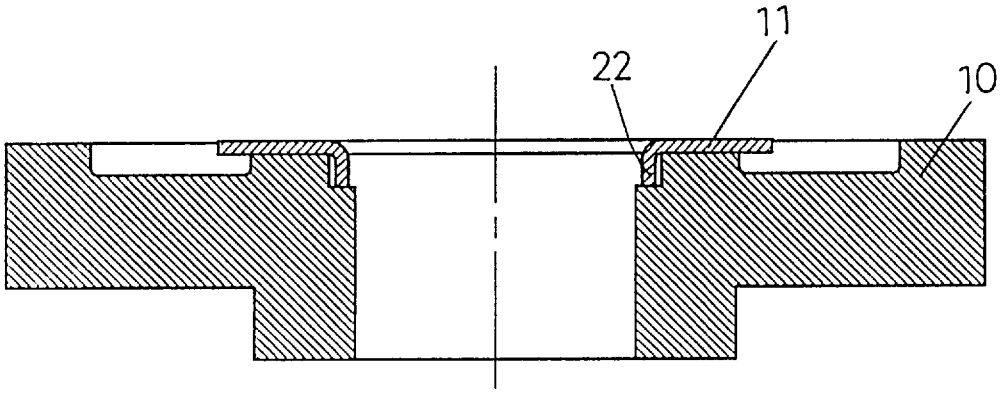
Fig. 4 PRIOR ART
FIG. 4 is a longitudinal sectional view showing another example of method of fixing a thrust plate.

Preferred embodiments of the scroll compressor according to the present invention will be hereinafter described referring to FIG. 1. The whole construction of the scroll compressor is basically the same as the one described above referring to FIG. 2, and thus only the differences will be described.

The reference numeral 3 designates an orbiting scroll member on which an orbiting scroll vane 3*a* is formed, 10 represents a bearing and 11 represents a thrust plate having a circular hole 11*a* in its center. There are protrusions 12 formed on the same plane with the thrust plate 11 projecting from the internal periphery of the circular hole 11*a* at two points along the direction of a diameter. The bearing member 10 has a thrust plate holder 10*a* for receiving the thrust plate 11 in its center. Projected along the internal periphery of the thrust plate holder 10*a* is a circular boss 13 having a lower height than the thickness of the thrust plate 11, to which the internal periphery of the thrust plate 11 is coupled. The circular boss 13 is provided with recesses 14 in which the protrusions 12 are fitted to be engaged in the direction of rotation. The depth of the recesses 14 is formed greater than the height of the circular boss 13.

According to the construction described above, the thrust plate 11 remains stationary even when orbiting motion of the orbiting scroll member 3 is exerted thereto, since the thrust plate 11 is fixed in the direction of rotation by the engagement between its protrusions 12 and the recesses 14 in the bearing 10. It can thus be prevented that the contacting parts between the thrust plate 11 and the bearing 10 will wear out by rotation of the thrust plate 11.

Also, as the thrust plate 11 and the bearing 10 are coupled only by engagement of the protrusions 12 and the recesses 14, the thrust plate 11 can move in the axial direction. Therefore, when precessional thrust loads are exerted on the thrust plate 11 by orbiting rotation of the orbiting scroll member 3, the thrust plate 11 smoothly follows up the movement of the orbiting scroll member 3 by slightly tilting, rising, or shifting in a similar way corresponding to force exerted places of the thrust loads. Abrasion between the outer circumferential surface of the thrust plate 11 and the correspondingly contacting parts of the orbiting scroll member 3 can be thereby prevented. Moreover, lubricating oil supplied to the joint between the crankshaft 6 and the orbiting scroll member 3 further assures the smooth shifting of the thrust plate 11 by entering into gaps made between the thrust plate 11 and the bearing 10 when the thrust plate 11 tilts or rises.

Since the protrusions 12 are formed as parts of the thrust plate 11 in one plane, dimensional accuracy can be easily achieved as well as reduction of production costs. Moreover, as reduction of the thrust plate 11 is formed in such a way that its outer periphery is circular and it has the protrusions 12 projecting from the inner periphery, abrasion on the outer circumferential surface caused by precessional thrust loads can be more stably prevented.

Further, even if the plane of the protrusions 12 are not perfectly flat, deflected abrasion can be prevented as the protrusions 12 are able to escape into the recesses 14 when thrust loads are exerted thereon from the scroll vane member 3, because the recesses 14 for engagement with the thrust plate 11 formed on the bearing 10 side have a greater depth than the height of the circular boss 13.

According to the scroll compressor of the present invention, as can be seen from the above descriptions, the circular thrust plate 11 is disposed between the orbiting scroll member 3 and the bearing 10 for receiving a force in the axial direction exerted from the orbiting scroll member 3, and a mating means is provided for preventing rotational movement of the thrust plate 11, at the same time permitting its movement in the axial direction. The abrasion of the thrust plate 11 caused by its rotation can be thus prevented by the mating means stopping the thrust plate 11 from rotating. Also, abrasion on the outer circumferential surface of the thrust plate 11 can be prevented, as the thrust plate 11 can move in the axial direction and thus follow up a precessional movement of the thrust load by slightly and smoothly shifting.

The mating means simply comprises protrusions 12 projecting in the radial direction formed on the same plane as the annular thrust plate 11 and the corresponding part formed in the bearing 10 for coupling with the protrusions 12, facilitating precise and economical production.

Further, abrasion on the outer circumferential surface of the thrust plate 11 caused by precessional movement of a thrust load can be more stably prevented by forming the outer periphery of the thrust plate 11 to be circular and by projecting protrusions 12 from the inner periphery of the thrust plate 11.

Moreover, deflected abrasion can be prevented by constructing the part in the bearing 10 with a circular boss 13 to which the inner periphery of the thrust plate 11 fits in, and recesses 14 formed in the circular boss 13 having a greater depth than the height of the circular boss 13 are provided.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

We claim:

1. A scroll compressor comprising:

a fixed scroll member having a fixed scroll vane;

an orbiting scroll member having an orbiting scroll vane interengaging with the fixed scroll vane for forming a plurality of compression spaces;

a crankshaft for providing a driving force to orbit the orbiting scroll member;

a bearing for supporting a main axis of the crankshaft; and a circular thrust plate having a circular hole disposed between the orbiting scroll member and the bearing for receiving a force axially exerted thereon from the orbiting scroll member, wherein a protrusion is formed in the same plane as the thrust plate and is extended within the circular hole of the thrust plate toward an inside position in a radial direction, and the bearing includes a thrust plate holder having a circular boss of a smaller outside diameter than the circular hole in the thrust plate and a coupler for mating with said protrusion for preventing rotation of the circular thrust plate, the thrust plate is thereby coupled to the bearing such as to be able to in an axial direction.

2. A scroll compressor according to claim 1, wherein the thrust plate holder includes a recessed portion which is formed in the circular boss and concaved in an axial direction, in which the protrusion of the thrust plate is received when mounted on the bearing, the recessed portion having a greater depth than the height of the circular boss.

3. In a scroll compressor for compressing a refrigerant with an orbiting scroll member driven to rotate in an operative manner relative to a fixed scroll member by crankshaft, the improvement comprising:

a bearing member operatively supporting the crankshaft;

a thrust plate having a circular hole positioned between the orbiting scroll member and the bearing member, the bearing member includes a central thrust plate holder having an aperture for receiving a shaft of the orbiting scroll member and a circular boss encircling the aperture and of a smaller outside diameter than the circular hole in the thrust plate, the circular boss has at least one indent, the thrust plate has a thickness greater than a height of the circular boss to thereby extend above the circular boss when mounted on the bearing member, the thrust plate has at least one radially extending protrusion with a surface lying in the same plane as an upper surface of the thrust plate, the protrusion extends within the indent of the circular boss to prevent relative rotation between the bearing member and the thrust plate.

4. The invention of claim 3 wherein a pair of indents are provided in the circular boss and a pair of protrusions are provided on the thrust plate to be cantilevered into the indents of the circular plate, the depth of the indents is greater than its height of the circular boss whereby the thrust plate and the bearing member are engaged only by the protrusions and the recesses and the thrust plate can follow the movement of the orbiting scroll member in response to thrust loads.

5. A scroll compressor comprising:

a fixed scroll member having a fixed scroll vane;

an orbiting scroll member having an orbiting scroll vane interengaging with the fixed scroll vane for forming a plurality of compression spaces;

a crankshaft for providing a driving force to orbit the orbiting scroll member;

a bearing for supporting a main axis of the crankshaft;

a circular thrust plate having a circular hole disposed between the orbiting scroll member and the bearing for receiving a force axially exerted thereon from the orbiting scroll member; and a mating means for preventing rotation of the circular thrust plate while permitting the thrust plate to shift in an axial direction, including a pair of protrusions with a surface lying in the same plane as an upper surface of the thrust plate, the protrusions extending radially toward an inside position within the circular hole of the thrust plate, and a thrust plate holder formed in the bearing for coupling with the protrusions of the thrust plate.

6. The scroll compressor according to claim 5, wherein the thrust plate holder comprises a circular boss and a pair of recessed portions formed in the circular boss at positions corresponding to the pair of protrusions of the thrust plate, the recessed portions having a greater depth than the height of the circular boss, by which the thrust plate is coupled to the bearing, such as not to rotate but to be able to shift in an axial direction.

* * * * *